US005676028A

United States Patent [19]

Jordan

[11] Patent Number: 5,676,028

[45] Date of Patent: Oct. 14, 1997

[54] SOCKET ADAPTER DEVICE

[76] Inventor: Robert J. Jordan, 4950 Jersey Ave. North, Crystal, Minn. 55428

[21] Appl. No.: 612,813

[22] Filed: Mar. 11, 1996

[51] Int. Cl.[6] ..... B25B 23/00

[52] U.S. Cl. ..... 81/177.2; 81/177.85; 279/144

[58] Field of Search ..... 81/177.2, 177.85, 81/58.3, 58.4, 473, 474, 475; 279/141–145, 139

[56] References Cited

U.S. PATENT DOCUMENTS 4,436,005 3/1984 Hanson ..... 81/177.85 X
4,750,750 6/1988 Batalorf, Jr. ..... 81/177.85 X
5,282,638 2/1994 Harper ..... 81/177.85 X
5,442,980 8/1995 Ringer ..... 81/177.85

*Primary Examiner*—D. S. Meislin
*Attorney, Agent, or Firm*—Herman H. Bains

[57] ABSTRACT

An adapter for interconnecting a generally rectangular socket wrench to a power drill includes an elongate main body comprising cylindrical portion having a rectangular shaped socket engaging member at one end thereof. The main body also includes an enlarged intermediate portion having an elongate shaft extending therefrom. A collet including chuck engaging collet shape is positioned around the main body shaft and is provided with a radial flange at one end thereof. Locking pins releasably lock the collet to the main body. Actuator means are provided for shifting the locking pins between locked and unlocked positions.

8 Claims, 1 Drawing Sheet

SOCKET ADAPTER DEVICE

FIELD OF THE INVENTION

This invention relates to an adapter device for interconnecting a socket wrench to a power tool.

BACKGROUND OF THE INVENTION

Socket wrenches are sometimes driven by rotary power tools for facilitating tightening or loosening nuts. Adapters have been used to interconnect socket wrenches to the chuck of the power tool. For example, U.S. Pat. No. 4,436,005 discloses a rigid adapter having a rigid non-circular drive shaft for engagement with the tool chuck and a rigid drive end portion for connection to the socket wrench. The configuration of the adapter prevents rotational slippage during operation of the power tool.

U.S. Pat. No. 4,750,750 discloses an adapter for a socket wrench including a spring urged detent for releasably locking the square head driver to the socket to prevent accidental disengagement of the socket and adapter.

All prior art adapters known to applicant make no provision for permitting slippage between the power tool and adapter under conditions which will cause damage to the adapter and/or power tool.

SUMMARY OF THE INVENTION

It is an object of this invention to provide a novel adapter for use in connecting a socket wrench to a power tool. The novel and improved adapter is constructed to readily disengage the drive from the power tool to the socket wrench. The adapter includes a main body connected to a chuck engaging collet. The main body is provided with a socket engaging member. The collet is locked to the main body by locking means but may be readily released from locked condition by actuation of a lock releasing bonnet.

DESCRIPTION OF THE PREFERRED EMBODIMENT

Figures 1, 2, 3:
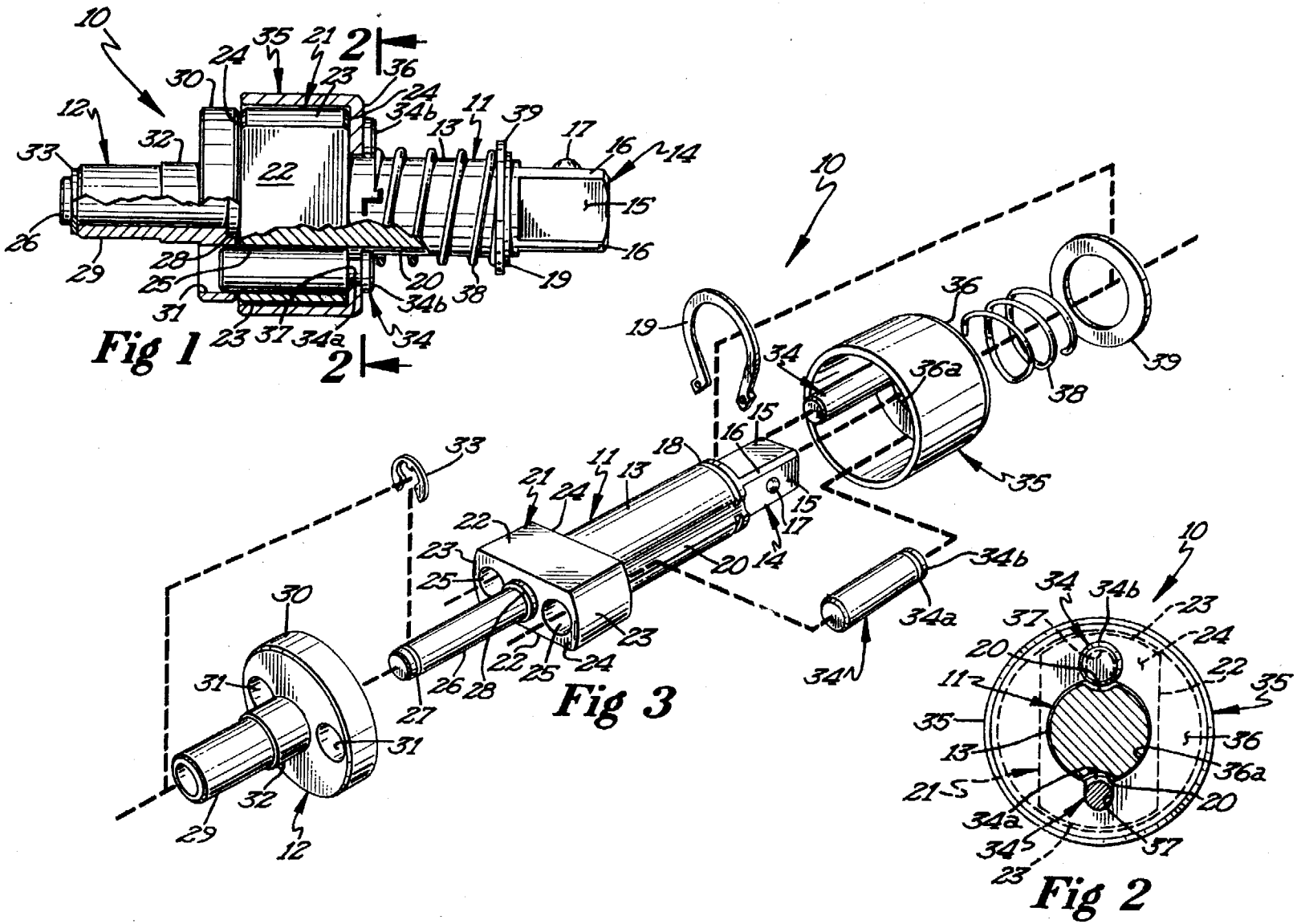
FIG. 1 is a side elevational view of the novel adapter with certain parts thereof broken away for clarity.
FIG. 2 is a cross-sectional view taken approximately along line 2—2 of FIG. 1 and looking in the direction of the arrows/
FIG. 3 is an exploded perspective view of the novel adapter illustrating the interrelationship of the various components.

Referring now to the drawings and more specifically to FIG. 1, it will be seen that I have provided a novel socket adapter, device designated generally by the reference numeral 10, which is used to interconnect a rotary power tool to a socket wrench. The adapter device 10 includes an elongate main body 11 which is connected to a chuck engaging collet 12. The collet is inertable into the chuck of a rotary power drill and is releasably locked thereto in the conventional manner. The main body 11 includes a central cylindrical portion 13 which is integrally connected with a socket engaging member 18 at one end thereof. It will be seen that the socket engaging member 14 is of generally rectangular configuration having side surfaces 15, and beveled longitudinal surfaces 16 located between adjacent side surfaces. The socket engaging member 14 is provided with a spring urged ball detent 17 of well known construction. The socket engaging member is inserted into the socket wrench and locked thereto by the detent 17 in a well known manner.

The central cylindrical portion 13 is provided with an annular recess 18 adjacent the socket engaging member 14 and the annular recess accommodates a horseshoe shaped spring clip 19 therein. The central cylindrical portion 13 also has a pair of elongate longitudinal extending grooves 20 therein and it will be noted that the grooves 20 are located 180° apart. The grooves 20 extend throughout the length of the central cylindrical portion 13.

The main body 11 also includes an enlarged intermediate portion 21 which has a generally rectangular shape including opposed flat sides 22, opposed curved sides 23, and opposed flat ends 24. The enlarged intermediate portion 21 also has a pair of elongate longitudinally extending openings 25 therethrough and it will be noted that the openings 25 are disposed approximately 180° apart. The openings 25 also communicate with the grooves 20 in the central cylindrical portion 13.

The main body 11 also includes an elongate collet engaging shaft 26 which extends from the enlarged intermediate portion 21. The collet engaging shaft 26 is of cylindrical configuration and has an annular recess 27 in the outer end thereof and has an enlarged annular element 28 integrally therewith which is also integral with the enlarged immediate portion 21.

The chuck engaging collet 12 includes an elongate cylindrical collet shaft 29 having an enlarged radial flange 30 integrally formed therewith and extending radially outwardly therefrom. The flange 30 has a pair of openings 31 therethrough. The collet shaft 29 has an enlarged portion 32 which extends from the flange 30.

The collet engaging shaft 26 of the main body 11 projects through the collet shaft 29 and is secured thereto by a spring clip 33 which engages in the recess 27 in the outer end of the shaft 26. The openings 31 and the flange 30 are disposed in aligned relation with the openings 25 in the enlarged portion 24 of the main body 11.

Means are provided for releasably locking the collet 12 against rotational movement relative to the main body 13. This means includes a pair of elongate locking pins 34 each positioned within one of the grooves 20 in the central cylindrical portion 13 and projecting through the openings 25 of the enlarged portion 21 of the main body and through the openings 31 in the flange 30 of the collet 12. The pins prevent angular movement of the collet relative to the shaft 26. It will be noted that each pin 34 has an annular groove **34*a* therein adjacent one end thereof to thereby define an annular head 34*b*. The grooves 20 and opening 25 serve as mounting means and guides for the locking pins 34**.

Means are provided for normally urging and retaining the locking pins in interlocked relation with the collet and for shifting the locking pins out of such locked relation. This means include a cylindrical bonnet 35 having an end wall 36 at one end thereof. The end wall 36 is provided with a central opening **36*a* therein and is also provided with a pair of grooves or slots 37 which are disposed in opposed relation with respect to each other and which communicate with the central opening 36*a* therein. The grooves 37 are of a size to closely fit within the annular grooves 34*a* of the locking pins 34. The grooves 37 being 180° apart will engage and retain the locking pins 34 when the bonnet 35 is applied to the central cylindrical portion 13 of the main body 11**.

A helical spring 38 is also positioned around the cylindrical portion 13 of the main body 11 and extends between and engages the bonnet 35 and the washer 39. The spring clip 19 engages in the groove 18 of the central cylindrical portion 13 and retains the washer 39 and helical spring 38 in mounted relation on the central portion 13. It will be seen that the spring 38 urges the bonnet 35 and the locking pins 34 into interlocked relation with the chuck engaging collet 12.

In use, the adapter provides an effective but safe interconnection between a socket wrench and a power tool. The collet shaft 29 is inserted into the chuck of the rotary power drill and is locked therein in the conventional manner. The enlarged portion 32 of the collet shaft 29 has a diameter large enough to fit into the chuck's outermost bore with a clearance that allows for a more rigid mating of the chuck to the adapter assembly. It is pointed out that the power tool most often used with the adapter will be a conventional drill and will impart rotary movement to the adapter. When the collet is applied to a drill chuck, the enlarged portion 32 will engage in the outermost part of the drill chuck to assist in the stability of the adapter device 10 under load. The collet shaft 29 will be engaged by the locking elements of the drill chuck to releasably lock the adapter device to the power tool.

The socket engaging member 14 will engage the socket wrench and will be locked thereto by the detent 17. Under normal operating conditions, the spring 38 will normally urge the bonnet 35 to the position illustrated in FIG. 1 to thereby lock the main body to the chuck engaging collet 12. When the drill is energized, rotary movement will be imparted to the socket engaging member 14 and socket wrench to thereby effect tightening or loosening a nut.

In the event that the torque load needed to remove a nut exceeds a predetermined wrench pressure, damage can occur to either the adapter device or the tool. It is not uncommon to require a wrench pressure of 100 psi when removing tightly threaded or frozen lugs. When these conditions are encountered, a user may shift the bonnet 35 in a longitudinal direction and allow slippage to occur between the chuck engaging collet and the main body including the socket engaging member. It will be seen that when the bonnet is shifted longitudinally, the locking pins 34 will also be moved longitudinally in a direction towards the socket engaging member 14. The locking pins become disengaged from the chuck engaging collet and thereby allow slippage. The chuck engaging collet may again be locked to the main body by simply releasing the bonnet 12 which is usually urged to the locking position by the helical spring 38.

It will therefore be seen that I have provided a novel adapter device for use in interconnecting a socket wrench to a rotary power tool, which is not only of simple and inexpensive construction, but one which functions in a more efficient manner than any heretofore known comparable device.

What is claimed is:

1. An adapter for interconnecting a socket wrench to the chuck of the rotary power tool, comprising;

an elongate main body having a generally rectangular socket engaging member at one end thereof for releasable engagement with a socket wrench, said main body including an elongate shaft at the other end thereof, an elongate generally cylindrically shaped chuck-engaging collet telescopically positioned around said shaft for locking engagement with the chuck of a rotary power tool, locking means mounted on said main body for shifting movement between locked and released positions, said locking means when in the locked position engaging and locking said collet to said main body and when in the released position disengaging said collet to permit rotation of the collet relative to said shaft, an actuator means mounted on said main body and normally urging said locking means to the locked position, and being shiftable to move said locking means to the release position.

2. The adapter as defined in claim 1 wherein said locking means includes an elongate pin.

3. The adapter as defined in claim 1 wherein said collet includes an elongate cylindrical shaft positioned around said shaft on said main body, and a radial flange secured to said elongate cylindrical shaft, said radial flange receiving said locking means when the latter is in the locked position.

4. The adapter as defined in claim 3 wherein said main body has openings therein, each being disposed in aligned relation with an opening in the radial flange, said locking means projecting into said openings in the radial flange and main body.

5. An adapter for interconnecting a socket wrench to the chuck of the rotary power tool, comprising;

an elongate main body including an elongate cylindrical portion, a generally rectangular socket engaging member at one end of said cylindrical portion for releasable engagement with a socket wrench, said main body including an elongate shaft at the other end thereof, an intermediate enlarged portion between said cylindrical portion and said shaft, guide means on said main body, an elongate generally cylindrically shaped chuck-engaging collet telescopically positioned around said shaft for locking engagement with the chuck of a rotary power tool, locking means mounted on said main body and engaging said guide means for shifting movement between locked and released positions, said locking means when in the locked position engaging and locking said collet to said main body and when in the released position disengaging said collet to permit rotation of the collet relative to said shaft, an actuator means mounted on said main body and normally urging said locking means to the locked position, and being shiftable to move said locking means to the release position.

6. The adapter as defined in claim 5 wherein locking means includes pins engageable and moveable in said guide means, and said actuator means includes a bonnet engaging said locking pins and being mounted on said cylindrical portion for movement relative thereto.

7. The adapter as defined in claim 6 wherein said collet includes a cylindrical collet shaft positioned around said main body shaft and a radial flange integral with said collet shaft and extending radially outwardly therefrom.

8. The adapter as defined in claim 7 wherein said guide means includes openings in said enlarged intermediate portion, and said locking means includes openings in said radial flange.

* * * * *